US005191808A

United States Patent [19]

Calvert

[11] Patent Number: 5,191,808

[45] Date of Patent: Mar. 9, 1993

[54] ACTUATOR END STOP ARRANGEMENT

[75] Inventor: Michael A. Calvert, Kirkaldy, Great Britain

[73] Assignee: Prime Actuator Control Systems Limited, Glenrothes, United Kingdom

[21] Appl. No.: 768,756

[22] PCT Filed: Apr. 20, 1990

[86] PCT No.: PCT/GB90/00615

§ 371 Date: Dec. 20, 1991

§ 102(e) Date: Dec. 20, 1991

[87] PCT Pub. No.: WO90/12964

PCT Pub. Date: Nov. 1, 1990

[30] Foreign Application Priority Data

Apr. 20, 1989 [GB] United Kingdom ..... 8908985

[51] Int. Cl.[5] ..... F01B 31/14; G05G 1/04

[52] U.S. Cl. ..... 74/526; 92/13.4; 92/13.7

[58] Field of Search ..... 92/13.4, 13.41, 13.6, 92/13.7, 138, 136; 74/526

[56] References Cited

U.S. PATENT DOCUMENTS

| | | | |
|---|---|---|---|
| 2,729,388 | 1/1956 | Ringham | 92/13.41 |
| 2,976,844 | 3/1961 | Goldring | 92/13.41 |
| 3,104,592 | 9/1963 | Sheesley | 92/13.6 |
| 3,371,553 | 3/1968 | Miner | 74/526 |
| 3,958,493 | 5/1976 | Fujita et al. | 92/13.8 |
| 4,265,132 | 5/1981 | Robertson . | |

FOREIGN PATENT DOCUMENTS

| | | | |
|---|---|---|---|
| 1321969 | 7/1987 | U.S.S.R. | 74/526 |

*Primary Examiner*—Thomas E. Denion

*Attorney, Agent, or Firm*—Mason, Fenwick & Lawrence

[57] ABSTRACT

The arrangement comprises a stop bar (1) formed from a cylindrical rod having a lengthwise slot therein. The stop bar (1) is secured to a fixed support within an actuator casing (7). A stop plate (15) is slidably secured in the slot and presents upper and lower stop edge portions (16, 17) for engagement with spaced limbs (23) of arm means for converting linear motion into angular motion. The position of the stop edge portions (16, 17) relative to the stop bar (1) is adjustable by means of replaceable shims (21) in the slot.

4 Claims, 1 Drawing Sheet

ACTUATOR END STOP ARRANGEMENT

BACKGROUND OF THE INVENTION

This invention relates to an actuator end stop arrangement and more particularly, for an actuator wherein linear motion is converted to angular motion, an end stop arrangement for the angular motion of an arm means which is driven by linear motion and delivers angular motion to a shaft.

The conventional end stop arrangement comprises large adjustment screws and lock nuts. However, such arrangements take up a great deal of space and it is an object of the invention to provide a simple construction which is effective and takes up less space than the conventional arrangement.

SUMMARY OF THE INVENTION

According to the invention, there is provided, an end stop arrangement for the angular motion of an arm means in an actuator wherein linear motion is received by the arm means and is converted by the arm means into angular motion and delivers such angular motion to a shaft, the arrangement comprising an assembly of a stop bar formed from a cylindrical rod but having a lengthwise slot therein, means for securing the stop bar to a fixed support within the actuator casing both in a sense lengthwise of the stop bar and angularly about its axis, a stop plate slidably secured in the slot and presenting a stop edge for engagement with the arm means, the position of the stop edge relative to the stop bar being adjustable by the insertion or removal of spacer means in the slot and engaging an edge of the stop plate remote from the stop edge.

BRIEF DESCRIPTION OF THE DRAWING

An embodiment of the invention will now be described, by way of example, with reference to the accompanying drawing, in which.

DESCRIPTION OF THE PREFERRED EMBODIMENT

Figure 1:
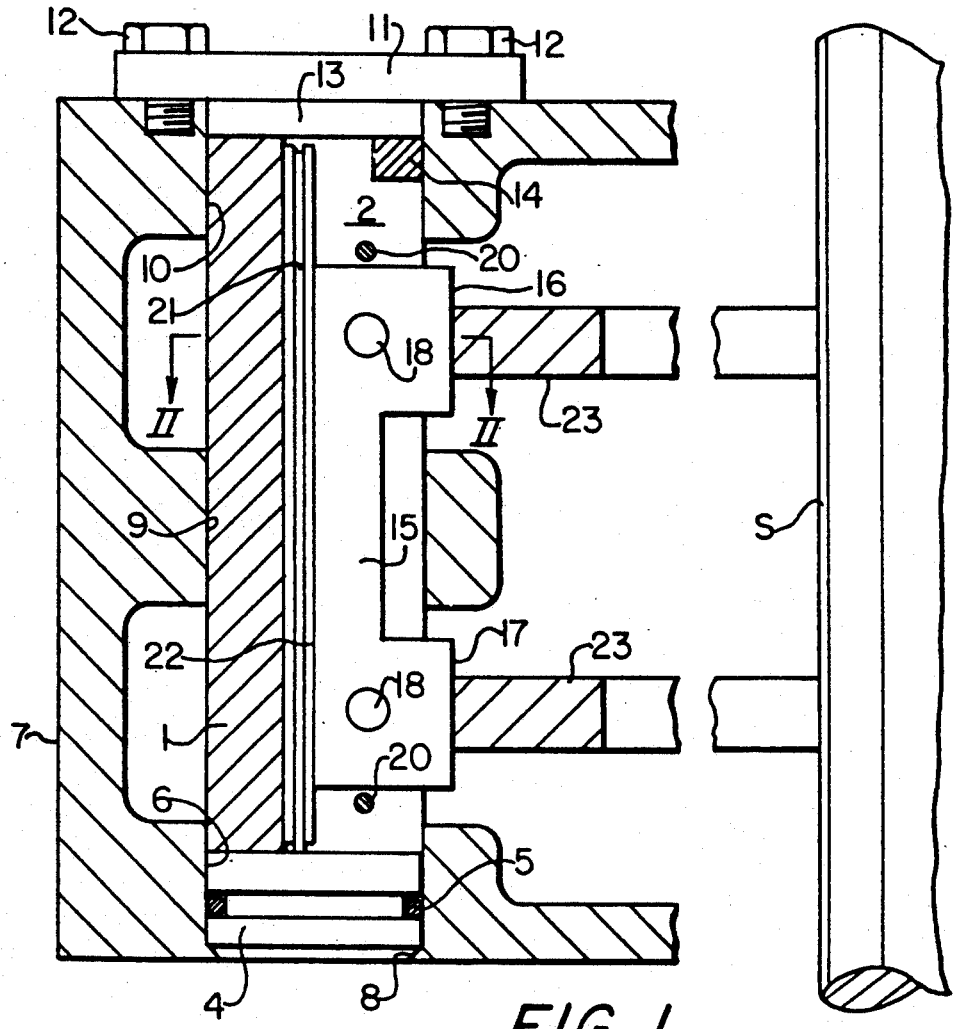
FIG. 1 is an elevation, partially in section, of an end stop arrangement, according to the invention, assembled in position in a fixed support within an actuator casing and shown in contact with arm means of the actuator.
Figure 2:
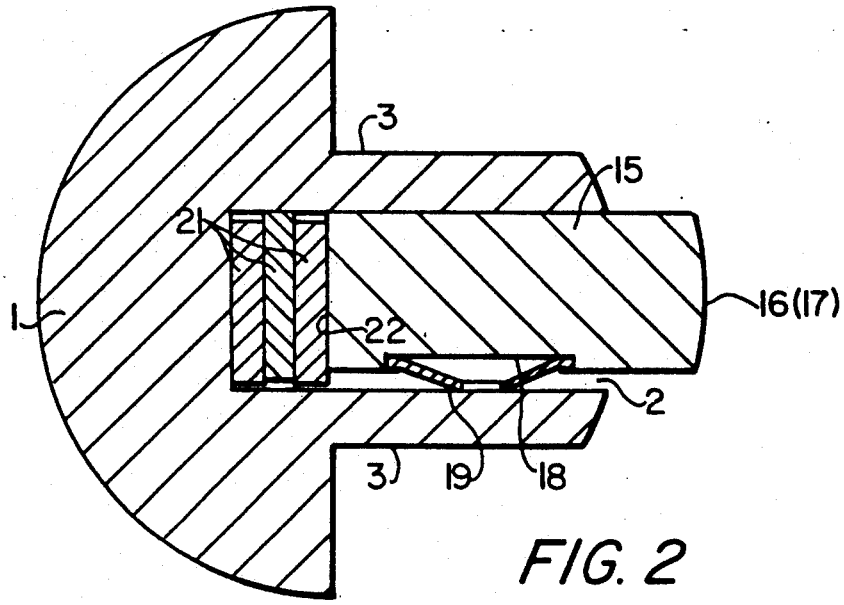
FIG. 2 in a section, to an enlarged scale, on line II—II in FIG. 1.

In the drawing, a stop bar 1 is formed from a cylindrical rod. A lengthwise slot 2 is cut in the stop bar 1. As shown, the bar I is relieved at each side of the slot 2 to provide two parallel wings 3. Two pairs of aligned holes are provided through the wings 3 near the upper and lower ends of the stop bar 1.

A cylindrical end part 4 is welded to the bottom end of the stop bar 1 and has an annular groove receiving an 0-ring 5 sealing a bottom bore 6 in the actuator casing 7. The bottom bore 6 has a shoulder 8 against which the end part 4 seats. The casing 7 also has an intermediate bore and an upper bore 10 aligned with the bore 6 and the stop bar 1 is housed within all three bores A cap 11 is bolted at 12 to the casing 7 and covers the bore 10. The cap 11 has a spigot 13 which enters the bore 10 and engages the upper end surface of the stop bar 1. A location peg 14 extends from the spigot 13 into the slot 2.

Thus the stop bar 1 is secured in a lengthwise sense and in an angular sense.

A stop plate 15 is housed in the slot 1 and presents an upper stop edge portion 16 between the bores 9 and 10, a lower stop edge portion 17 between the bores 6 and 9, and a relief intermediate the edge portions 16, 17 and registering with the intermediate bore 9. On one side of the plate 15 adjacent to each edge 16, 17 is a circular recess 18 which receives a disc spring 19 slidably securing the plate 15 in the slot 2. Endwise movement of the plate 15 is limited by pins 20 inserted in the aligned holes in the wings 3 and spanning the slot 2. The position of the stop edge portions 16, 17 relative to the stop bar 1 is adjusted by the insertion or removal of spacer shims 21 in the slot 2 and engaging the edge 22 of the stop plate 15 remote from the stop edge portion 16, 17.

In FIG. 1 the arm means of the actuator is shown as two spaced limbs 23 of yoke which has an angular motion.

The end stop arrangement is assembled as follows. The disc springs 19 are located in the recesses 18. The pins 20 are fitted to the stop bar 1. The stop plate 15 and located disc springs 19 are inserted laterally into the slot between the pins 20. The stop bar 1, with its bottom end part 4, is inserted into the aligned bores 6, 9, 10 from above until seated on the shoulder 8. The stop plate 15 is pushed fully into the slot 2 so that the plate clears the bores. With the yoke limbs 23 clear of the end stop arrangement, the stop plate 15 is levered outwards of the slot 2 and the required number of shims 21 is inserted into the space left in the slot 2 from above. Any surplus shims 21 are inserted in the spaces on the outer sides of the wings 3 ready for possible future use. The stop bar 1 is turned to its correct angular position and the cap 11 is applied with the spigot 13 entering the bore 10 and the peg 14 entering the slot 2.

In a modification the part 4 may be replaced by a cap similar to cap 11 with or without the peg 14.

It will be noted that the arrangement described and illustrated cannot lose adjustment between the limbs 23 as could happen with screws and nuts in the conventional arrangement.

Claim:

1. An end stop arrangement for angular motion of an arm means in an actuator wherein linear motion is received by the arm means and is converted by the arm means into angular motion and delivers such angular motion to a shaft, the arrangement comprising an assembly of a stop bar formed from a cylindrical rod but having a lengthwise slot therein, securing means for securing the stop bar to a fixed support within the actuator casing both in a sense lengthwise of the stop bar and angularly about its axis, a stop plate slidably secured in the slot and presenting a stop edge for engagement with the arm means, the position of the stop edge relative to the stop bar being adjustable by the insertion or removal of the spacer means in the slot and engaging an edge of the stop plate remote from the stop edge.

2. An end stop arrangement according to claim 1, wherein the slot opens into at least one end of the stop bar, the slot has an open end, the securing means comprises a cap for closing the open end of the slot, the stop plate is so dimensioned as to be fully receivable in the slot in the absence of the spacer means, and the spacer means are in the form of shims which are insertable into the slot from said open end of said slot after the assembled stop bar and stop plate has been installed in the actuator casing and the stop plate has been partially levered out of the slot, but before the cap has been installed.

3. An end stop arrangement according to claim 2, wherein the stop bar is relieved at each side of the slot to provide two parallel wings leaving spaces for housing surplus shims.

4. An end stop arrangement according to claim 1, wherein the actuator housing has three aligned bores, the arm means includes two spaced limbs, the stop edge of the stop plate has upper and lower stop edge portions interrupted by an intermediate relief, the intermediate relief is positioned to register with an intermediate one of the three aligned bores in the actuator housing, the upper and lower stop edge portions of the stop edge being positioned to be engaged on both sides of the intermediate bore by the two spaced limbs of the arm means.

* * * * *